US008488989B2

(12) United States Patent
Ukai

(10) Patent No.: US 8,488,989 B2
(45) Date of Patent: Jul. 16, 2013

(54) IMAGE FORMING DEVICE HAVING EXHAUST CHANNEL FOR EXHAUSTING AIR OUT OF THE DEVICE

(75) Inventor: Masamitsu Ukai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 263 days.

(21) Appl. No.: 12/959,871

(22) Filed: Dec. 3, 2010

(65) Prior Publication Data

US 2011/0217066 A1 Sep. 8, 2011

(30) Foreign Application Priority Data

Mar. 8, 2010 (JP) ..... 2010-050585

(51) Int. Cl.
*G03G 21/20* (2006.01)

(52) U.S. Cl.
USPC ..... 399/93; 399/92; 399/94

(58) Field of Classification Search
USPC ..... 399/92, 93
See application file for complete search history.

(56) References Cited

U.S. PATENT DOCUMENTS 4,693,588 A * 9/1987 Yarbrough et al. ..... 399/93
6,141,512 A * 10/2000 Nagano et al. ..... 399/92
6,628,906 B2 * 9/2003 Kimizuka ..... 399/44
7,289,747 B2 * 10/2007 Miyamoto et al. ..... 399/92
7,720,430 B2 * 5/2010 Hasegawa et al. ..... 399/397
8,170,432 B2 * 5/2012 Takeuchi ..... 399/49
2003/0185584 A1 10/2003 Hirose et al.
2005/0078976 A1 * 4/2005 Deguchi et al. ..... 399/92
2006/0072933 A1 * 4/2006 Miyamoto et al. ..... 399/92
2006/0269315 A1 * 11/2006 Ito ..... 399/92
2007/0071484 A1 * 3/2007 Igarashi ..... 399/92
2008/0187349 A1 * 8/2008 Yoshihara et al. ..... 399/92
2011/0103820 A1 * 5/2011 Yamamoto et al. ..... 399/93

FOREIGN PATENT DOCUMENTS

JP 05-023537 2/1993
JP 05-050465 7/1993
JP 06-043723 2/1994
JP 08123265 A * 5/1996
JP 09-054527 2/1997
JP 2003-287996 10/2003
JP 2010-079047 4/2010

* cited by examiner

*Primary Examiner* — David Gray
*Assistant Examiner* — Francis Gray
(74) *Attorney, Agent, or Firm* — Banner & Witcoff, Ltd.

(57) ABSTRACT

An image forming device includes a main casing, a process unit, a fixing unit, and a duct. The duct is disposed between the process unit and the fixing unit with respect to a direction in which a recording medium is conveyed. The duct defines an exhaust channel for exhausting air out of the main casing. The duct includes at least two partitioning walls extending in a second direction intersecting with the first direction, and is formed with at least three inlet ports partitioned by the partitioning walls in the first direction.

10 Claims, 9 Drawing Sheets

IMAGE FORMING DEVICE HAVING EXHAUST CHANNEL FOR EXHAUSTING AIR OUT OF THE DEVICE

CROSS REFERENCE TO RELATED APPLICATION

This application claims priority from Japanese Patent Application No. 2010-050585 filed Mar. 8, 2010. The entire content of this priority application is incorporated herein by reference.

TECHNICAL FIELD

The present invention relates to an image forming device for forming images on a recording medium.

BACKGROUND

There has been proposed an electrophotographic image forming device, such as a laser printer, including a duct for exhausting air out of the device. The duct includes two ducts divided by a single partitioning wall, one for exhausting ozone and the like generated by a Scorotron charger and the other for exhausting heat generated at a fixing unit.

SUMMARY

However, when heat generated by the fixing unit increases temperature of the partitioning wall, heat is radiated from the partitioning wall and transmitted to a process unit (process cartridge), and adversely affects a photosensitive layer of a photosensitive member and the like.

In view of the foregoing, it is an object of the invention to provide an image forming device capable of suppressing heat transmission from a fixing unit to a process unit.

In order to attain the above and other objects, the invention provides an image forming device including a main casing, a process unit, a fixing unit, and a duct. The process unit includes an image-bearing member onto which an electrostatic latent image is formed, a developing unit that supplies developing agent to the electrostatic latent image formed on the image-bearing member to form a developing-agent image on the image-bearing member, and a transfer unit that transfers the developing-agent image from the image-bearing member onto a recording medium. The fixing unit thermally fixes the developing-agent image onto the recording medium. The duct is disposed between the process unit and the fixing unit with respect to a first direction in which the recording medium is conveyed. The duct defines an exhaust channel for exhausting air out of the main casing. The duct includes at least two partitioning walls extending in a second direction intersecting with the first direction, and is formed with at least three inlet ports partitioned by the partitioning walls in the first direction.

BRIEF DESCRIPTION OF THE DRAWINGS

The particular features and advantages of the invention as well as other objects will become apparent from the following description taken in connection with the accompanying drawings, in which:

FIG. 8(*b*) is a cross-sectional top view of a duct according to another modification of the embodiment;

FIG. 9(*b*) is a perspective view of a duct having another modified channel wall.

DETAILED DESCRIPTION

A laser printer 1 as an example of an image forming device according to an embodiment of the invention will be described while referring to the accompanying drawings.

The terms "upper," "lower," "above," "below," "beneath," "right," "left," "front," "rear" and the like will be used throughout the description assuming that the laser printer 1 is disposed in an orientation in which it is intended to be used. In use, the laser printer 1 is disposed as shown in FIG. 1.

Figure 1:
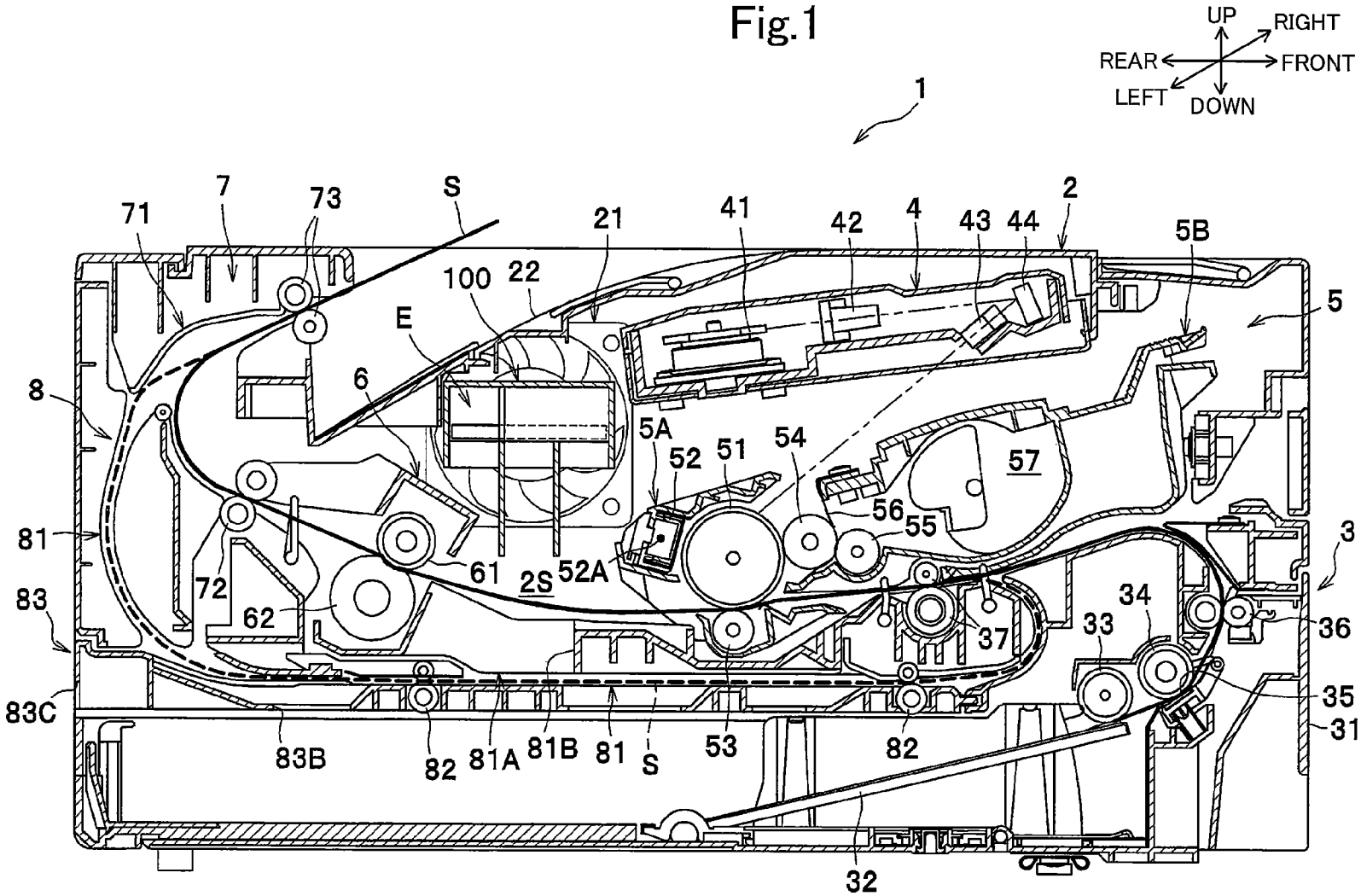
FIG. 1 is a cross-sectional view of a laser printer as an image forming device according to an embodiment of the invention.

As shown in FIG. 1, the laser printer 1 is configured to be able to form images on both sides of a paper sheet S (a recording medium), and includes a main casing 2 and, within the main casing 2, a paper supply unit 3, an exposure device 4, a process cartridge 5, a fixing device 6, a discharge unit 7, a reversing unit 8, a duct 100, and a fan 21.

Figure 2:
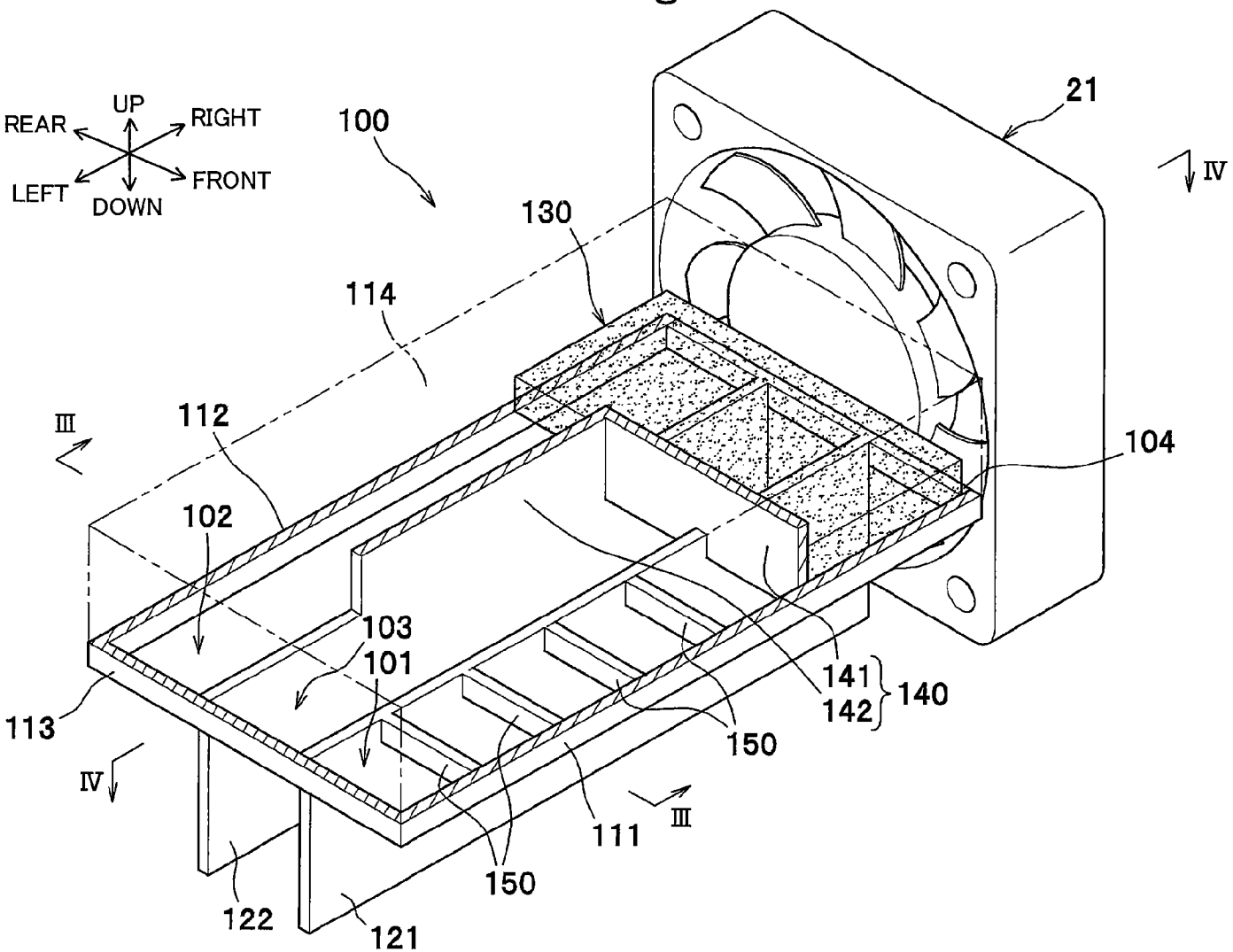
FIG. 2 is a perspective view showing configuration of a duct of the laser printer.

The fan 21 is disposed at a right-side wall (not shown) of the main casing 2 on the right side of the duct 100 as shown in FIG. 2. The fan 21 exhausts air out of the main casing 2, thereby cooling inside of the main casing 2 and various components of the laser printer 1. The fan 21 also exhausts heat and vapor generated at the fixing device 6, volatile compounds (VOC) contained in toner (developing agent), and ozone generated at the process cartridge 5 (more specifically, a charging wire 52A of the process cartridge 5).

The supply unit 3 is disposed in the bottom section of the main casing 2, and includes a paper tray 31, a pressing plate 32, a paper supply roller 33, a separation roller 34, a separation pad 35, a feed roller 36, and registration rollers 37. A stack of paper sheets S accommodated in the paper tray 31 is moved toward the paper supply roller 33 by the pressing plate 32 and fed by the paper supply roller 33. An upper most paper sheet S is separated from the stack by the separation roller 34 and the separation pad 35, and fed by the feed roller 36 and the registration rollers 37 toward a position between a photosensitive drum 51 and a transfer roller 53 to be described later.

The exposure device 4 is disposed in an upper section of the main casing 2, and includes a laser generator (not shown) that generates a laser light based on image data, a polygon mirror 41 that is driven to rotate, lenses 42 and 43, and a reflection mirror 44. As indicated by a dotted line in FIG. 1, the laser light generated by the laser generator is reflected by the polygon mirror 41, passes through the lens 42, is reflected by the reflection mirror 44, passes through the lens 43, and is scanned on the surface of the photosensitive drum 51 at a high speed.

The process cartridge 5 is disposed below the exposure device 4. The process cartridge 5 can be detached from the main casing 2 through an opening (not shown) formed thereto after opening a front cover of the main casing 2 and replaced with new one. The process cartridge 5 includes a photosensitive unit 5A and a developing unit 5B.

The photosensitive unit 5A includes the photosensitive drum 51 (image bearing member), a charger 52, and the transfer roller 53. The charger 52 includes the charging wire 52A (discharging unit) extended along an axial direction of the photosensitive drum 51. The charging wire 52A generates a corona discharge when applied with voltage, so as to uniformly charge the surface of the photosensitive drum 51.

The developing unit 5B is detachably mounted on the photosensitive unit 5A, and includes a developing roller 54, a supply roller 55, a thickness regulating blade 56, and a toner accommodating section 57 for accommodating toner.

In the process cartridge 5, after uniformly charged by the charger 52, the surface of the photosensitive drum 51 is exposed by the high-speed scanning of the laser light from the exposure device 4. As a result, an electrostatic latent image corresponding to image data is formed on the surface of the photosensitive drum 51. The toner accommodated in the toner accommodating section 57 is supplied by the supply roller 55 to the developing roller 54, enters between the developing roller 54 and the thickness regulating blade 56 to form a thin layer of a fixed thickness on the developing roller 54.

The toner held on the developing roller 54 is selectively supplied onto the electrostatic latent image on the photosensitive drum 51, thereby transforming the electrostatic latent image into a visible toner image. In this manner, the toner image (developing-agent image) is formed on the photosensitive drum 51. When the paper sheet S passes through the position between the photosensitive drum 51 and the transfer roller 53, the toner image is transferred from the photosensitive drum 51 onto the paper sheet S by the transfer roller 53 (transfer unit).

The fixing device 6 is disposed on the rear side of the process cartridge 5, and includes a heat roller 61 and a pressure roller 62. The pressure roller 62 is disposed in confrontation with the heat roller 61 and presses against the heat roller 61. When the paper sheet S with the toner image transferred thereon passes between the heat roller 61 and the pressure roller 62, the toner image is thermally fixed onto the paper sheet S. In this manner, the toner image is formed on one side of the paper sheet S.

The discharge unit 7 is disposed in the rear section of the main casing 2, and includes a discharge path 71 and discharge rollers 72 and 73. The discharge rollers 73 are controlled to rotate in a forward direction when discharging the paper sheet S out of the main casing 2 and to rotate in a reversed direction to feed the paper sheet S in an opposite direction when forming an image on the other side (rear surface) of the paper sheet S.

The paper sheet S discharged from the fixing device 6 is fed by the discharge rollers 72 along the discharge path 71. If an image forming operation has completed, the paper sheet S is discharged onto a discharge tray 22 by the discharge rollers 73 rotating in the forward direction. If an image still needs to be formed on a rear surface of the paper sheet S, on the other hand, the discharge rollers 73 start rotating in the reversed direction before the paper sheet S is completely discharged out of the main casing 2, so the paper sheet S is fed back into the main casing 2 toward the reversing unit 8.

The reversing unit 8 includes a reversing path 81 and a plurality of feed rollers 82 disposed alongside of the reversing path 81. The reversing path 81 extends downward in the rear section of the main casing 2, bends frontward to pass beneath the fixing device 6, the duct 100, and the process cartridge 5, and bends upward toward the process cartridge 5.

The paper sheet S fed to the reversing unit 8 with only an image formed on a front surface thereof is, as indicated by a dotted line, guided by the feed rollers 82 to move along the reversing path 81 toward the process cartridge 5. When the paper sheet S is fed back to the process cartridge 5 in this manner, another image is transferred onto a rear surface of the paper sheet S at the position between the photosensitive drum 51 and the transfer roller 53, and then thermally fixed at the fixing device 6. In this manner, the another image is formed on the rear surface of the paper sheet S. The paper sheet S discharged from the fixing device 6 thereafter is fed by the discharge rollers 72 to the discharge path 71 and discharged out of the main casing 2 onto the discharge tray 22 by the discharge rollers 73 rotating in the forward direction.

Next, the duct 100 will be described in detail. Note that accompanying drawings referred to in the following description are for showing distinctive structure of the duct 100, but do not necessarily reflect the accurate size and shape of the duct 100.

As shown in FIG. 1, the duct 100 is disposed between the process cartridge 5 and the fixing device 6 with respect to a front-rear direction in confrontation with the fan 21. The duct 100 forms an exhaust channel E for exhausting air out of the main casing 2.

As shown in FIG. 2, the duct 100 has (the exhaust channel E is defined by) a front wall 111 on the process cartridge 5 side, a rear wall 112 on the fixing device 6 side, a left wall 113, and an upper wall 114. The lower and right sides of the duct 100 are left open. More specifically, first, second, and third inlet openings 101, 102, and 103 are formed on the lower side of the duct 100 for introducing air within the main casing 2 into the exhaust channel E. An outlet opening 104 for exhausting air out of the exhaust channel E is formed on the right side of the duct 100 in confrontation with the fan 21.

The duct 100 has a front partitioning wall 121 and a rear partitioning wall 122 at the bottom. The front and rear partitioning walls 121 and 122 are extending in the left-right direction and partition the lower opening of the duct 100 in the front-rear direction into the first, second, and third inlet openings 101, 102, and 103. The first inlet opening 101 is located between the front partitioning wall 121 and the front wall 111 with respect to the front-rear direction. The second inlet opening 102 is located between the rear partitioning wall 122 and the rear wall 112 with respect to the front-rear direction. The third inlet opening 103 is located between the first inlet opening 101 and the second inlet opening 102 (between the front partitioning wall 121 and the rear partitioning wall 122).

Figure 3:
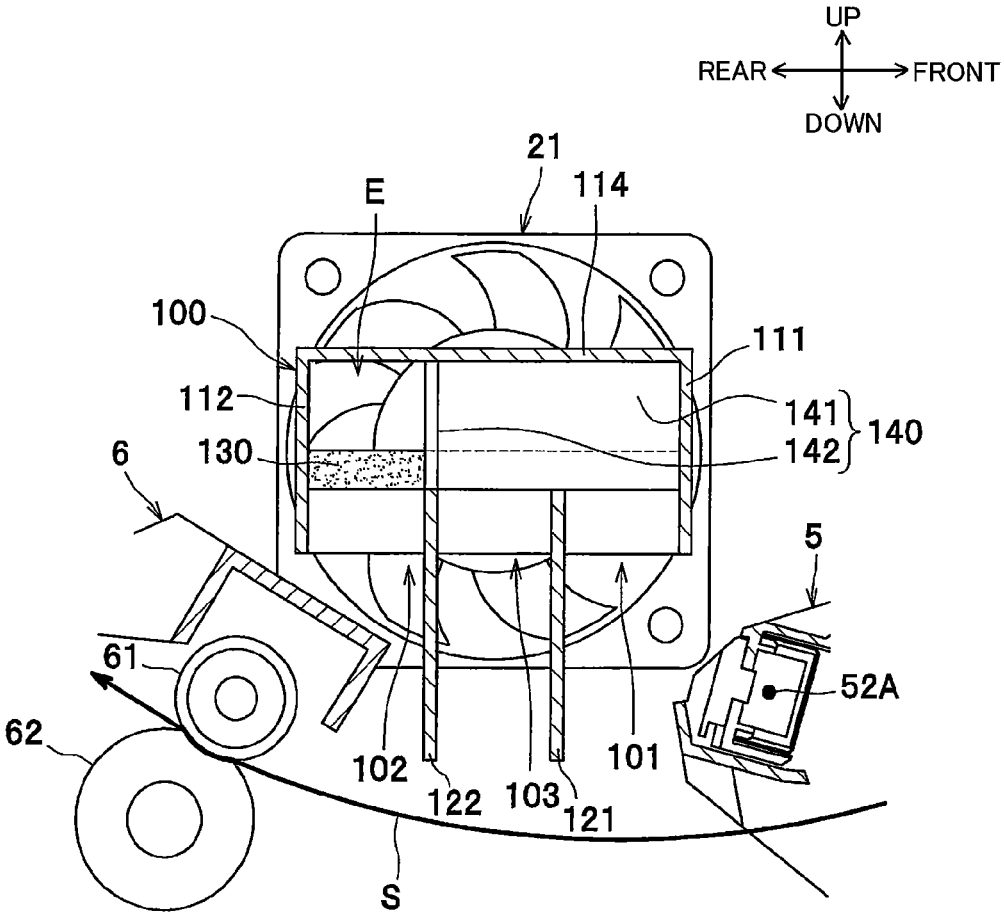
FIG. 3 is a cross-sectional side view taken along a III-III line of FIG. 2.

As shown in FIG. 3, the front and rear partitioning walls 121 and 122 are protruding toward a sheet conveying path through which the paper sheet S is conveyed from the process cartridge 5 toward the fixing device 6. In other words, the front and rear partitioning walls 121 and 122 extend downward from the bottom of the duct 100 so as to partition a space between the process cartridge 5 and the fixing device 6 in the front-rear direction.

Figure 4:
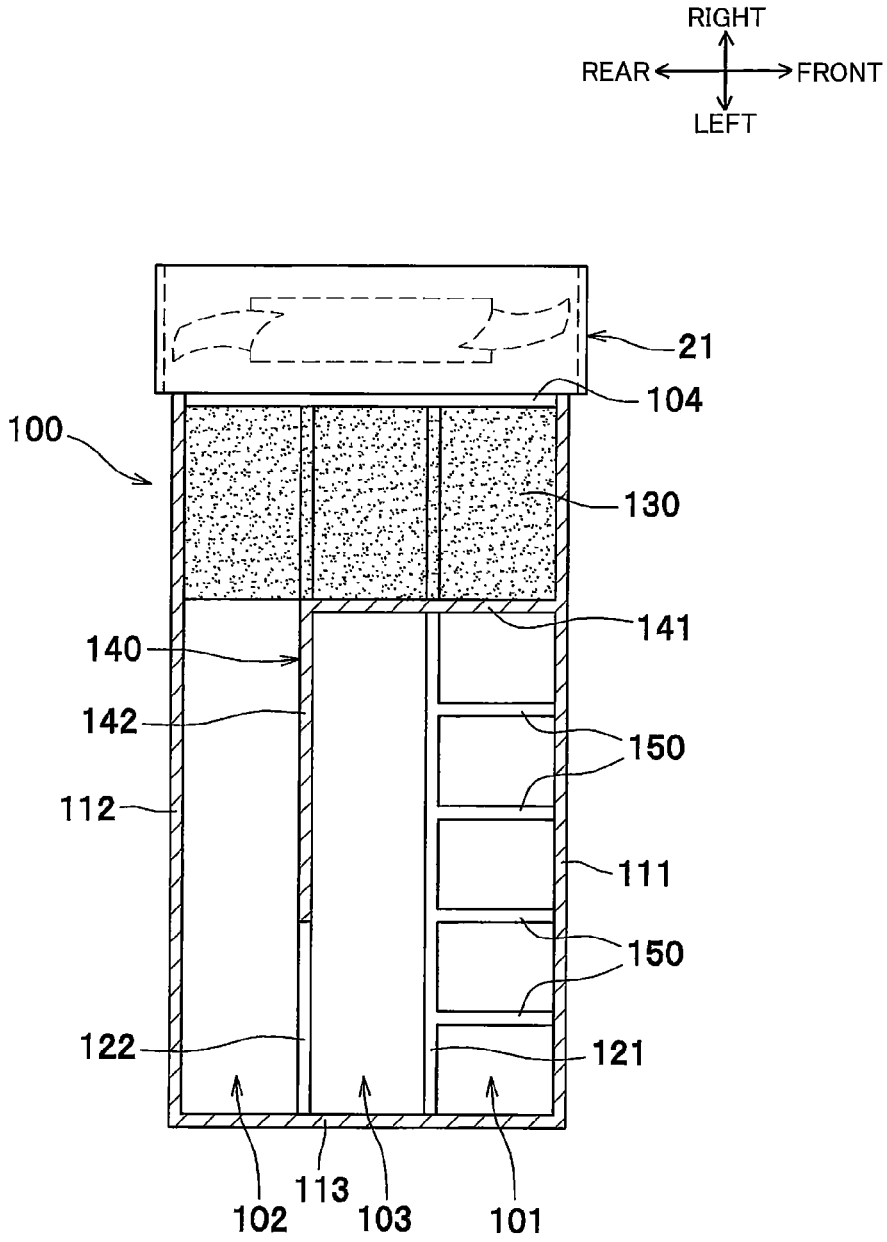
FIG. 4 is a cross-sectional top view taken along a IV-IV line of FIG. 2.

As shown in FIGS. 2 to 4, a filter 130 in substantially a plate shape is disposed in the duct 100 for absorbing VOC and ozone. More specifically, the filter 130 is disposed along the entire length of the duct 100 (the exhaust channel E) in the front-rear direction over the front and rear partitioning walls 121 and 122, spanning from the front wall 111 to the rear wall 112, and is biased rightward toward the fan 21. The filter 130 may be an activated carbon filter or a metal-oxide catalyst filter, for example.

The duct 100 is formed with a channel wall 140 therein. The channel wall 140 includes a first channel wall 141 and a second channel wall 142. As shown in FIG. 3, the channel wall 140 (the first channel wall 141 and the second channel wall 142) spans from upper edges of the front and rear partitioning walls 121 and 122 to the upper wall 114 of the duct 100 so as to connect each of the front and rear partitioning walls 121 and 122 with the upper wall 114.

As shown in FIGS. 2 and 4, the first channel wall 141 is disposed in an upright posture on the left side of the filter 130 so as to confront the fan 21 across the filter 130. The first channel wall 141 spans between the front wall 111 and the rear partitioning wall 122 over the front partitioning wall 121.

The second channel wall 142, on the other hand, extends leftward from a rear end of the first channel wall 141 along the rear partitioning wall 122 to a position rightward of the left wall 113, leaving a space between the second channel wall 142 and the left wall 113.

A plurality of (four) current walls 150 are disposed between the front partitioning wall 121 and the front wall 111. The current walls 150 extend in the front-rear direction and partition the first inlet opening 101 into five sections in the right-left direction.

Figure 6:
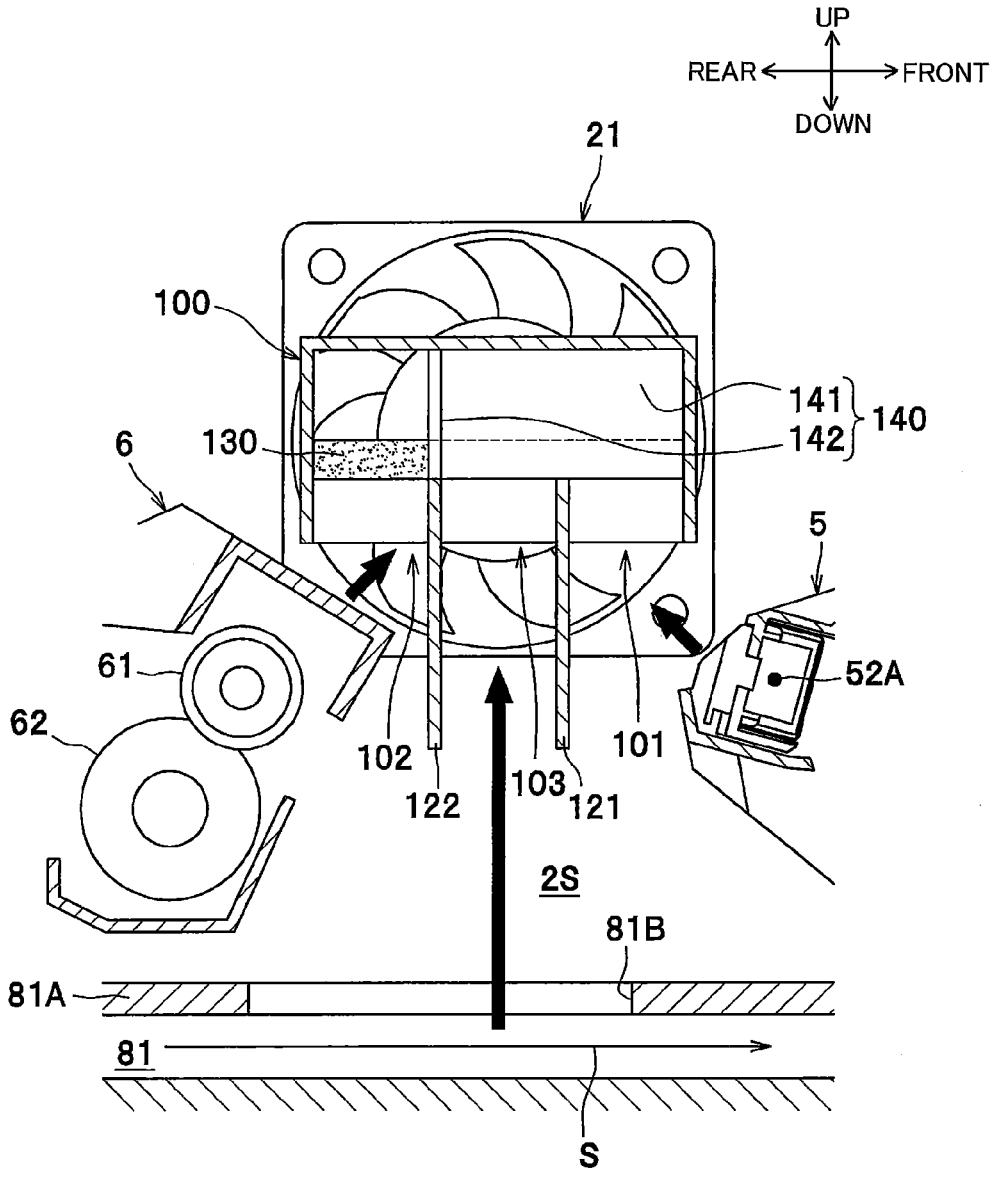
FIG. 6 is an explanatory cross-sectional side view of relevant parts of the laser printer, showing air flow into the duct.

As shown in FIG. 6, an upper wall 81A defining a part of the reversing path 81 extending in the front-rear direction is formed with an opening 81B that fluidly communicates the reversing path 81 with a space 2S in which the duct 100 is disposed. The opening 81B is positioned between the process cartridge 5 and the fixing device 6 and below the duct 100.

Figure 5:
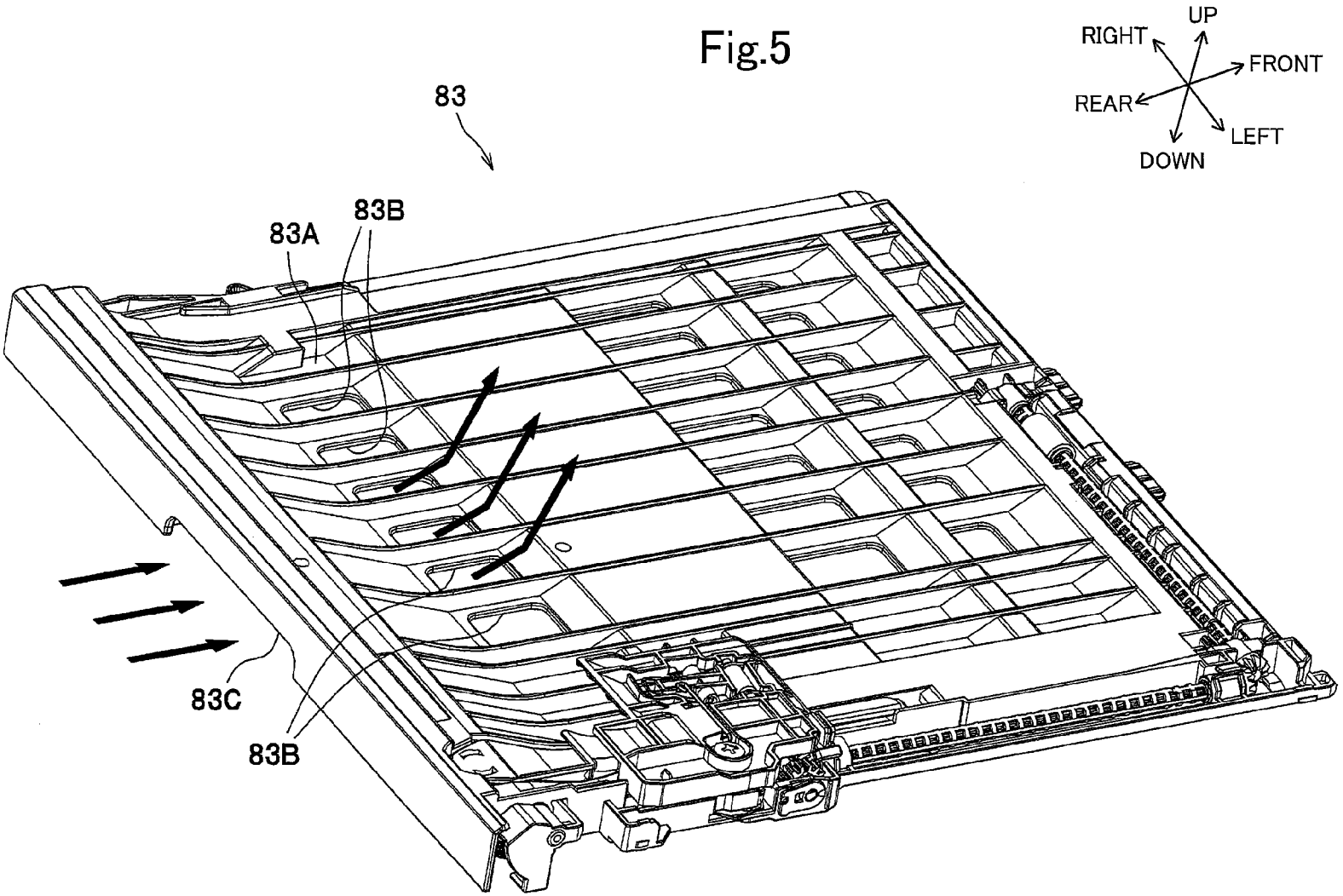
FIG. 5 is a perspective view of a reverse-conveying unit of the laser printer.

As shown in FIG. 1, the laser printer 1 also includes a reverse-conveying unit 83, which provides a bottom wall defining the part of the reversing path 81 extending in the front-rear direction. The reverse-conveying unit 83 is formed with a handle 83C. A user can grab the handle 83C and pull the reverse-conveying unit 83 rearward to detach the same from the main casing 2. As shown in FIG. 5, the reverse-conveying unit 83 has a bottom wall 83A formed with a plurality of openings 83B aligned in the right-left direction.

As shown in FIG. 6, the duct 100 positioned between the process cartridge 5 and the fixing device 6 in the front-rear direction has the front and rear partitioning walls 121 and 122 extending in the right-left direction as described above. Thus, even if heat generated at the fixing device 6 (the heat roller 61) increases the temperature of the rear partitioning wall 122, the front partitioning wall 121 prevents transmission of radiated heat to the process cartridge 5.

Also, because the inlet openings 101 to 103 are partitioned by the front and rear partitioning walls 121 and 122, air is drawn in the duct 100 through the third inlet opening 103 between the front and rear partitioning walls 121 and 122, and heat accumulation on the front and rear partitioning walls 121 and 122 is prevented.

More specifically, when the fan 21 is driven to rotate, air containing ozone and the like in the front section of the main casing 2 is drawn into the duct 100 mainly through the first inlet opening 101, and hot air containing vapor, VOC, and the like in the rear section of the main casing 2 is drawn into the duct 100 mainly through the second inlet opening 102, and air beneath the duct 100 is drawn mainly through the third inlet opening 103.

The air drawn through the third inlet opening 103 is cooler than the air drawn through the second inlet opening 102, and thus cools the front and rear partitioning walls 121 and 122 when flowing therebetween. In this manner, heat accumulation on the front and rear partitioning walls 121 and 122 (especially on the rear partitioning wall 122) is prevented, thereby suppressing temperature rise in the front and rear partitioning walls 121 and 122.

Also, a layer of air flowing in the third inlet opening 103 between the front and rear partitioning walls 121 and 122 prevents heat convection transfer from the fixing device 6 to the process cartridge 5.

Further, the front and rear partitioning walls 121 and 122 extending downward toward the paper-conveying path as shown in FIG. 6 partition a space in which the process cartridge 5 is disposed and a space in which the fixing device 6 is disposed, thereby preventing heat transfer from the fixing device 6 to the process cartridge 5 more reliably.

Moreover, because the filter 130 is biased toward the fan 21 and disposed along the entire length of the exhaust channel E in the front-rear direction over the front and rear partitioning walls 121 and 122 as shown in FIG. 2, the filter 130 can absorb and remove ozone and VOC while ensuring proper airflow.

Figure 7:
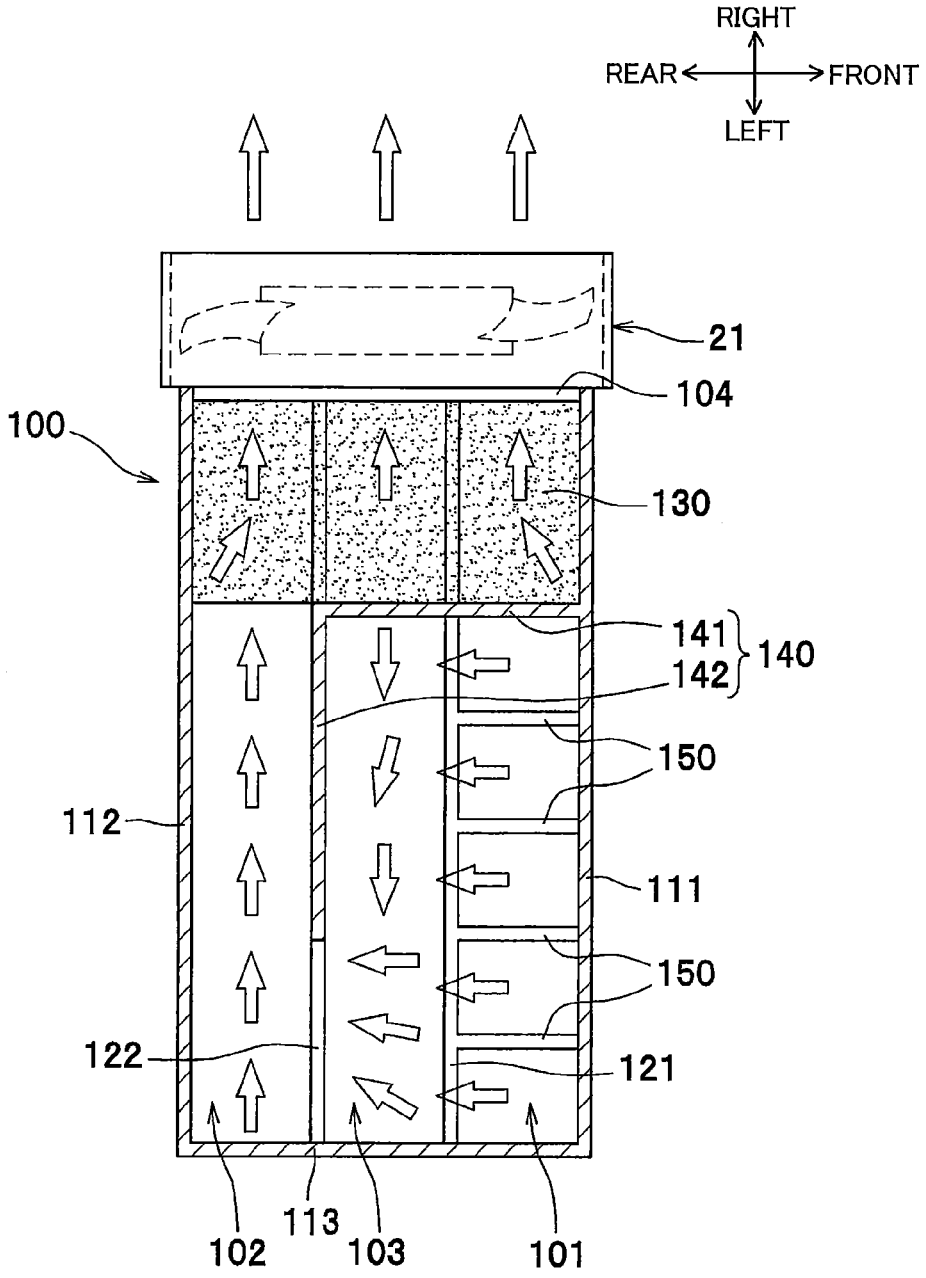
FIG. 7 is a cross-sectional top view showing air flow within the duct.

More specifically, as indicated by arrows in FIG. 7, some of the air drawn in through the inlet openings 101 and 103 passes through the filter 130, and remaining of the air does not pass through the filter 130.

If a filter is disposed along the entire width of the exhaust channel E in the right-left direction, then the filter may lessen airflow into the duct 100. However, according to the present embodiment, the filter 130 is located at the rightward position, proper airflow can be ensured.

In the above-described configuration, the fan 21 is disposed on the right side of the duct 100. Thus, air drawing force within the inlet openings 101 to 103 is greater on the right side than on the left side. Because the filter 130 is biased toward the fan 21, it is secured that a sufficient amount of air flows through the filter 130. That is, although the filter 130 is not disposed along the entire width of the duct 100 in the right-left direction, it is possible to absorb and remove ozone and VOC.

Because the filter 130 is not disposed along the entire width of the duct 100 in the right-left direction, production costs can be suppressed.

According to the present embodiment, because the channel wall 140 is provided, it is possible to lower the density of ozone exhausted out of the main casing 2 (the duct 100).

More specifically, as shown in FIG. 7, air drawn through the first and third inlet openings 101 and 103 into a space surrounded by the channel wall 140, the left wall 113, and the upper wall 114 initially flows leftward along the second wall 142, then flows through the space between the second channel wall 142 and the left wall 113 to above the second inlet opening 102, and then flows rightward toward the fan 21.

That is, the channel wall 140 makes the length of air passage through which air drawn through the first and third inlet openings 101 and 103 flows to the fan 21 longer than the length of air passage through which air drawn through the second inlet opening 102 flows to the fan 21.

Thus, it takes longer time to exhaust the air, which is drawn through the first inlet opening 101 and containing ozone, out of the duct 100. Being a relatively unstable molecule, most ozone vanishes within the duct 100 if it takes a relatively long time for ozone to be discharged from the duct 100, and the density of ozone exhausted out of the main casing 2 is lowered.

Because the length of the air passage for the air drawn through the first and third inlet openings 101 and 103 is elongated as described above, air which is drawn through the first inlet opening 101 and containing ozone is well mixed with clean air (air hardly containing ozone and VOC) drawn through the third inlet opening 103 within the duct 100 before exhausted. This further reduces the density of ozone exhausted from the duct 100.

In this embodiment, the plurality of current walls 150 extending along the front-rear direction are disposed between the front partitioning wall 121 and the front wall 111 as described above. With this configuration, air is dawn evenly through the first inlet opening 101, reducing the ozone density further reliably.

More specifically, because the fan 21 is located on the right side of the duct 100 in this embodiment, the air drawing force is greater on the right side than on the left side. As a result, more air is drawn on the right side if no current wall 150 is provided. In this case, the ozone density in the duct 100 may be larger in an area near and on the left side of the first channel wall 141 and will not be lowered sufficiently even if mixed with clean air.

In the present embodiment, however, the current walls 150 help to draw air through the first inlet opening 101 substantially evenly with respect to the right-left direction, substantially uniforming the ozone density in the duct 100. The ozone density is reduced further reliably by thereafter being mixed with clean air drawn in through the third inlet opening 103.

Because the current walls 150 function as reinforcing members also, the configuration of the duct 100 itself can be reinforced. Note that the current walls 150 may also be provided between the rear partitioning wall 122 and the rear wall 112 and between the front partitioning wall 121 and the rear partitioning wall 122.

Because the opening 81B is formed in the upper wall 81A of the reversing path 81 for communicating between the reversing path 81 and the space 2S in which the duct 100 is disposed, the paper sheet S being conveyed through the reversing path 81 can be cooled.

More specifically, if the paper sheet S being conveyed through the reversing path 81 is hot, then there is a danger that moisture in the paper sheet S evaporates to change the electric resistance value thereof. In this case, the electric resistance value of the paper sheet S differs between when forming an image on a front surface and when forming another image on a rear surface, resulting in different image qualities. According to this embodiment, however, change in the electric resistance value is suppressed, so the same image quality can be maintained between images on the front and rear surfaces of the paper sheet S.

As shown in FIG. 5, rotation of the fan 21 draws air into the reversing path 81 for cooling the paper sheet S through the handle 83C of the reverse-conveying unit 83, beneath the rear part of the reverse-conveying unit 83, and the plurality of openings 83B formed in the bottom wall 83A. Also, as shown in FIG. 6, air within the reversing path 81 is drawn through the opening 81B to the duct 100.

While the invention has been described in detail with reference to the embodiment thereof, it would be apparent to those skilled in the art that various changes and modifications may be made therein without departing from the spirit of the invention.

Figure 8A:
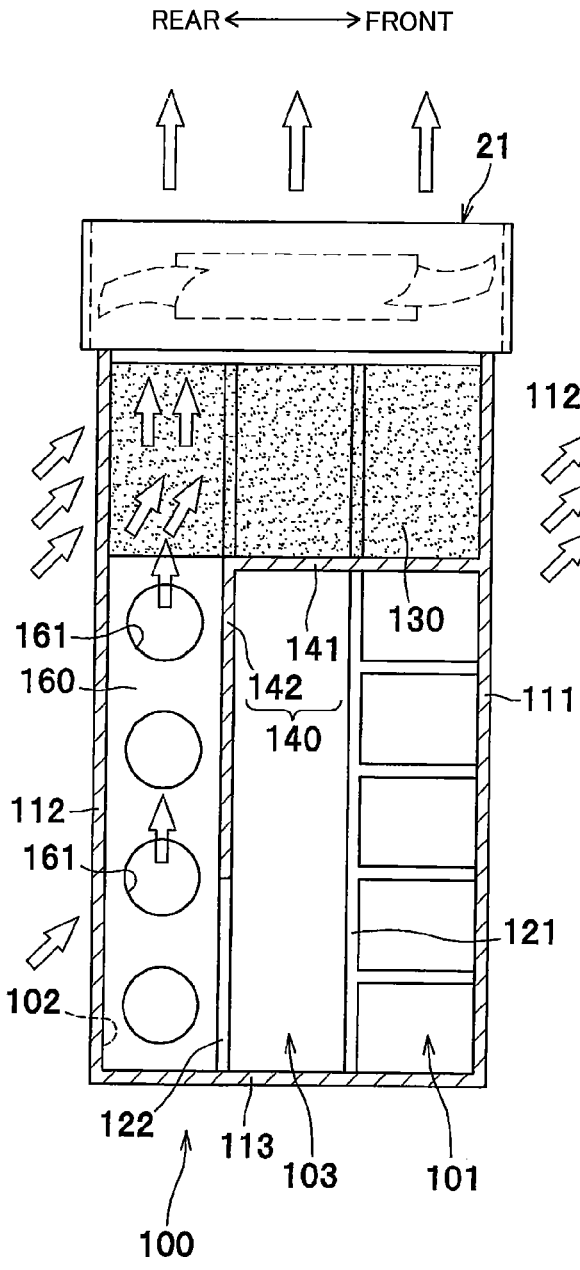
FIG. 8(*a*) is a cross-sectional top view of a duct according to a modification of the embodiment.
Figure 8B:
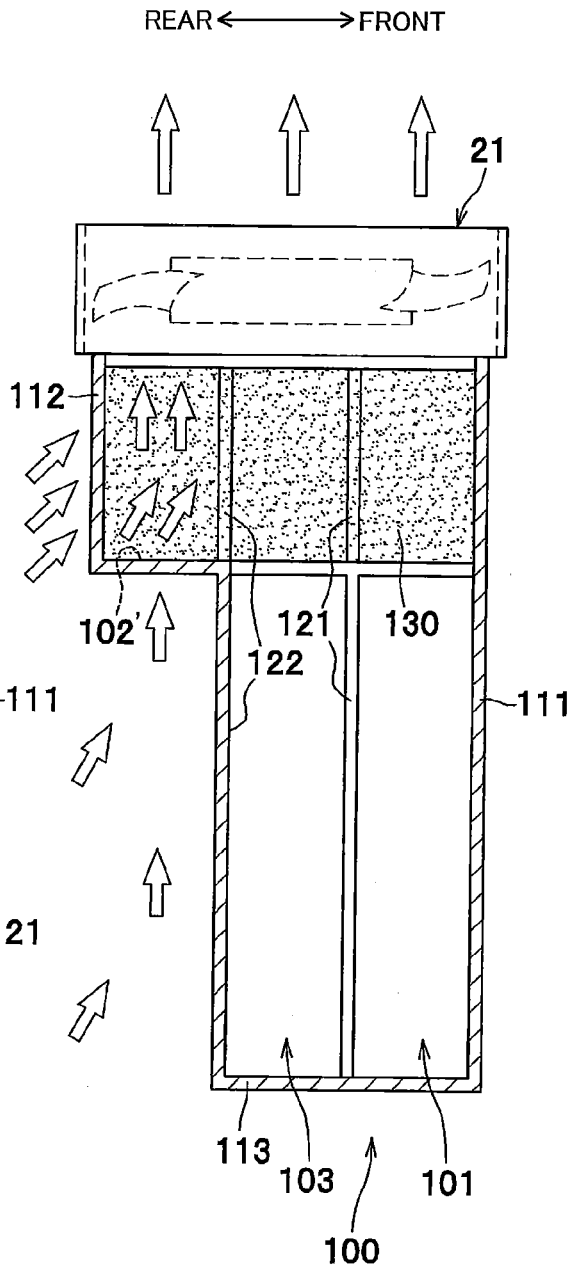

For example, as shown in FIG. 8(*a*), a restriction member 160 may be disposed between the rear partitioning wall 122 and the rear wall 112 at a position where the filter 130 is not located. The restriction member 160 is a plate-like member disposed to cover over the second inlet opening 102, and is formed with a plurality of (four) circular through holes 161.

With this configuration, the restriction member 160 regulates the amount of air drawn in through a section of the second inlet opening 102 where the filter 130 is not located. This increases an amount of air with VOC that passes through the filter 130, and makes it possible to absorb and remove VOC further reliably.

The restriction member 160 is not limited to the above-described configuration, but may be formed with slit-like through holes rather than the circular through holes 161 or formed with no through hole at all (a restriction member may completely cover over the section of the second inlet opening 102 where the filter 130 is not located). Still alternatively, a fibrous restriction member may be used for restricting the amount of air flow.

As shown in FIG. 8(*b*), the duct 100 may alternatively be formed with a second inlet opening 102' only at where the filter 130 is disposed so as to increase the amount of air with VOC that passes through the filter 130. In other words, the second inlet opening 102' may be entirely covered with the filter 130. With this configuration also, VOC can be reliably absorbed and removed.

The configuration of the channel wall 140 described above is a mere example, and the present invention is not limited thereto. For example, the channel wall 140 may only have the first channel wall 141 (FIG. 2), and the second channel wall 142 may be dispensed with. In this case, the height of the first channel wall 141 may be extended to the upper wall 114 of the duct 100, or a gap may be formed between the upper edge of the first channel wall 141 and the upper wall 114.

Figure 9A:
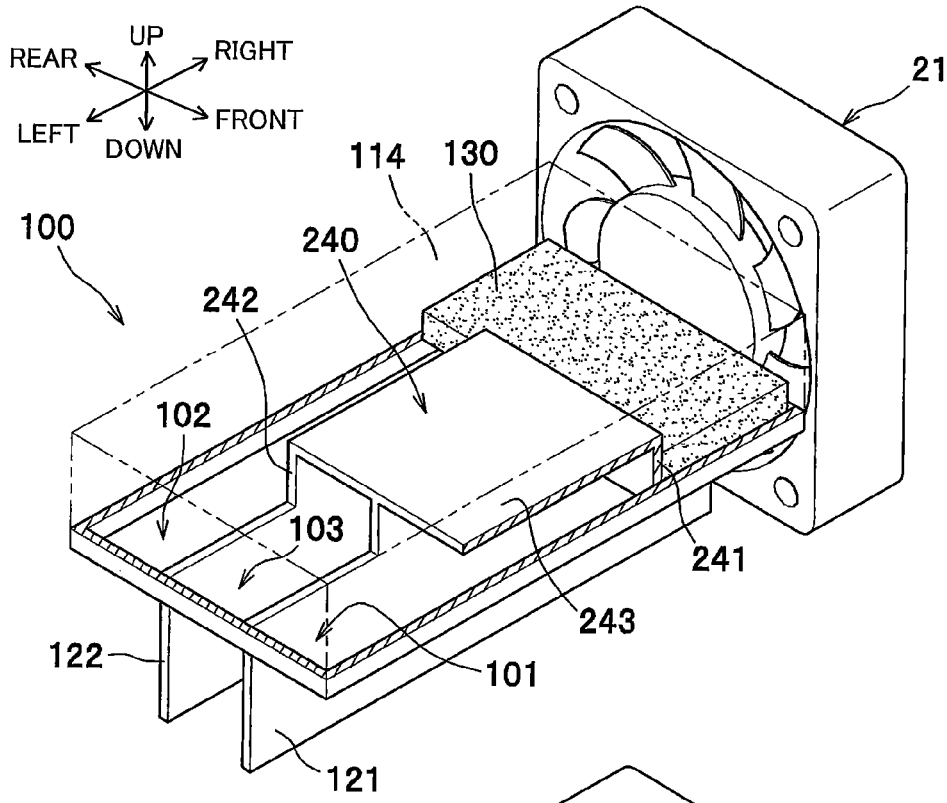
FIG. 9(*a*) is a perspective view of a duct having a modified channel wall.
Figure 9B:
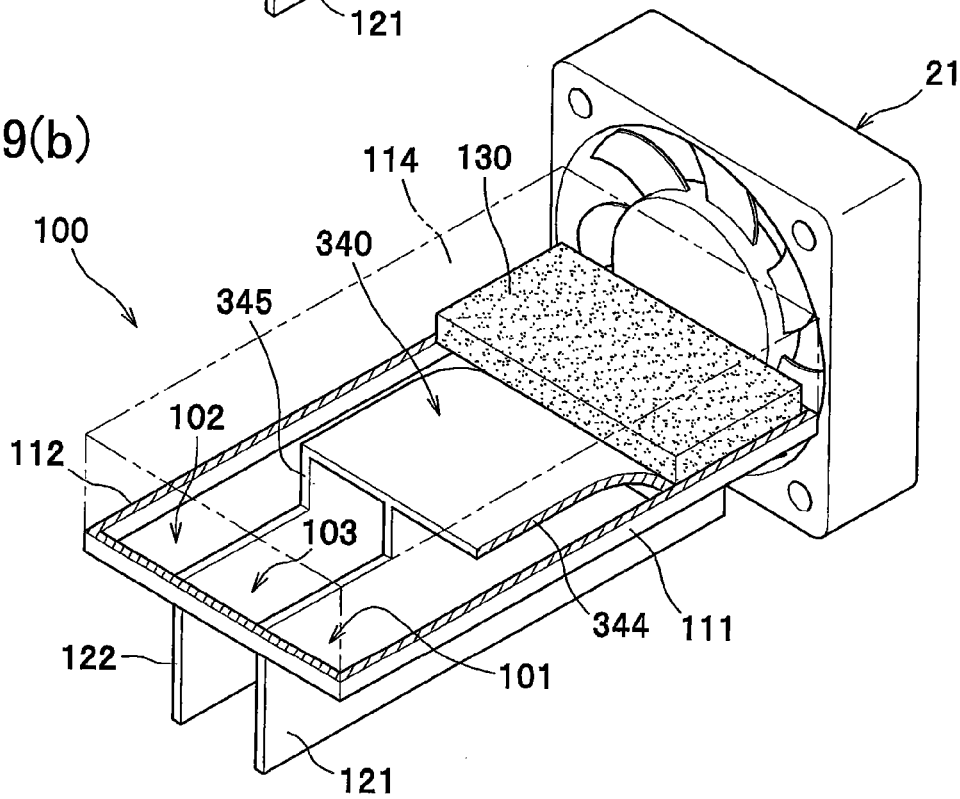

A channel wall 240 shown in FIG. 9(*a*) may be used instead of the channel wall 140. The channel wall 240 includes first, second, and third channel walls 241, 242, and 243. The first and second channel walls 241 and 242 are similar to the first and second channels walls 141 and 142 of the above-described embodiment, but have lower height so as to leave a gap between the first and second channels walls 241 and 242 and the upper wall 114 with respect to the up-down direction. The third channel wall 243 is extended leftward from the upper edge of the first channel wall 241 to substantially the same width as the second channel wall 242.

With this configuration, air drawn in the duct 100 through sections of the first and third inlet openings 101 and 103 leftward of the first channel wall 241 initially flows leftward along the second channel wall 242, then flows to above the second inlet opening 102 and the third channel wall 243, and then flows rightward toward the fan 21. Note that the second channel wall 242 may be omitted from the structure shown in FIG. 9(*a*).

Still alternatively, as shown in FIG. 9(*b*), a channel wall 340 may be used instead of the channel wall 140. The channel wall 340 has an upper channel wall 344 and a side channel wall 345. The upper channel wall 344 extends from a position leftward of the filter 130 in the upper-left direction in an arc shape and then extends toward the left. The upper channel wall 344 spans between the rear partitioning wall 122 and the front wall 111 with respect to the front-rear direction. The side channel wall 345 is disposed to connect the rear edge of the upper channel wall 344 to the rear partitioning wall 122.

With this configuration, air drawn in the duct 100 through sections of the first inlet opening 101 and the third inlet opening 103 just leftward of the filter 130 flows leftward along the channel wall 340, flows to above the second inlet opening 102 and the upper channel wall 344, and then flows rightward toward the fan 21. Note that the side channel wall 345 may be omitted from the structure shown in FIG. 9(*b*).

In the above-described embodiment, the fan 21 is disposed on the right side of the duct 100. However, the fan 21 may be disposed on the left or upper side of a duct. Although only single fan 21 is provided in the above-described embodiment, a plurality of fans may be provided.

In the above-described embodiment, the exhaust channel E is defined by the front wall 111, the rear wall 112, the left wall 113, and the upper wall 114. However, this is not limitation of the invention. An exhaust channel may be defined by a part of a main casing or a part of any component disposed within a main casing. For example, a top cover of a main casing may function as an upper wall of an exhaust channel, or a part of a frame for supporting the exposure device 4 may function as a part of a wall of an exhaust channel.

In the above-described embodiment, the two partitioning walls 121 and 122 are used. However, three or more number of partitioning walls may be used. Similarly, although three inlet openings 101 to 103 are provided in the above-described embodiment, four or more number of inlet openings may be provided. Partitioning walls may not be used for dividing between inlet openings. In this case, for example, a wall (or walls) may be disposed in the duct 100 to divide between inlet openings.

In the above-described embodiment, the laser printer 1 is described as an example of an image forming device of the invention. However, the image forming device of the invention may be a color printer for forming color images, a copier device, or a multifunction device.

In the above-described embodiment, the process cartridge 5 is described as an example of a process unit. However, the process unit may be a unit including a plurality of process cartridges and a frame that supports the process cartridges, if the invention is applied to a color printer.

The photosensitive drum 51 is described as an example of an image bearing member in the above-described embodiment, but the image bearing member may alternatively be a photosensitive belt, for example.

The developing unit 5B detachably attached to the photosensitive unit 5A is described as an example of a developing unit in the above-described embodiment. However, the developing unit may be a developing roller provided to a process cartridge including the photosensitive unit 5A and the developing unit 5B integrally formed with the photosensitive unit 5A, for example.

The transfer roller 53 is described as an example of a transfer unit in the above-described embodiment. However, the transfer unit may be an intermediate transfer belt or a transfer charger, for example.

The fixing device 6 including the heat roller 61 and the pressure roller 62 is described as an example of a fixing unit in the above-described embodiment. However, the fixing unit may be a fixing device employing a film fixing method, for example.

The charger 52 having the charging wire 52A is described as an example of a discharging unit in the above-described embodiment. However, the discharging unit may be a charging device (sawtooth charging device) having a line of needle electrodes or a charging roller, for example.

The paper sheet S such as plain paper or postcard is described as a recording medium in the above-described embodiment. However, the paper sheet S may be OHP sheet or the like.

What is claimed is:

1. An image forming device comprising:

a main casing;

a process unit including an image-bearing member onto which an electrostatic latent image is configured to be formed, a developing unit configured to supply developing agent to the electrostatic latent image formed on the image-bearing member to form a developing-agent image on the image-bearing member, and a transfer unit configured to transfer the developing-agent image from the image-bearing member onto a recording medium;

a fixing unit configured to thermally fix the developing-agent image onto the recording medium;

a duct disposed between the process unit and the fixing unit with respect to a first direction in which the recording medium is conveyed, the duct defining an exhaust channel for exhausting air out of the main casing;

a fan disposed on one side of the duct in the second direction and configured to exhaust air out of the main casing; and a filter disposed within the duct, wherein:

the duct includes at least two partitioning walls extending in a second direction intersecting with the first direction, and is formed with at least three inlet ports partitioned by the partitioning walls in the first direction;

the filter is disposed along the entire length of the exhaust channel in the first direction over the partitioning walls at a position biased toward the one side of the duct;

the process unit includes a discharging unit configured to generate a discharge for charging the image-bearing member;

the at least two partitioning walls include a first partitioning wall nearest the process unit and a second partitioning wall nearest the fixing unit;

the duct includes a first side wall and a second side wall located closer to the fixing unit than the first side wall;

the at least three inlet ports include a first inlet port located between the first partitioning wall and the first side wall with respect to the first direction, a second inlet port located between the second partitioning wall and the second side wall with respect to the first direction, and a third inlet port located between the first inlet port and the second inlet port with respect to the first direction;

the duct further includes a channel wall disposed in the exhaust channel;

the channel wall partially defines a first path through which air drawn in the exhaust channel through the first inlet port and the third inlet port flows to the fan and a second path through which air drawn in the exhaust channel through the second inlet port flows to the fan; and the first path is longer than the second path.

2. The image forming device according to claim 1, wherein each of the partitioning walls extends toward a conveying path through which the recording medium is conveyed from the process unit toward the fixing unit.

3. The image forming device according to claim 1, wherein the channel wall includes a first channel wall disposed in an upright posture to confront the fan across the filter, and the first channel wall spans between the second partitioning wall and the first side wall.

4. The image forming device according to claim 3, wherein the channel wall further includes a second channel wall extending from a first edge of the first channel wall nearest the fixing unit along the second partitioning wall in a direction away from the fan.

5. The image forming device according to claim 3, wherein the channel wall further includes a third channel wall extending from a second edge of the first channel wall farthest from the at least three inlet ports in a direction away from the fan.

6. The image forming device according to claim 1, wherein the channel wall includes a fourth channel wall extending from a position confronting with the fan across the filter in a direction away from the filter, and the fourth channel wall spans between the second partitioning wall and the first side wall.

7. An image forming device comprising:

a main casing;

a process unit including an image-bearing member onto which an electrostatic latent image is configured to be formed, a developing unit configured to supply developing agent to the electrostatic latent image formed on the image-bearing member to form a developing-agent image on the image-bearing member, and a transfer unit configured to transfer the developing-agent image from the image-bearing member onto a recording medium;

a fixing unit configured to thermally fix the developing-agent image onto the recording medium;

a duct disposed between the process unit and the fixing unit with respect to a first direction in which the recording medium is conveyed, the duct defining an exhaust channel for exhausting air out of the main casing;

a fan disposed on one side of the duct in the second direction and configured to exhaust air out of the main casing;

a filter disposed within the duct; and a plurality of current walls, each extending in the first direction, wherein:

the duct includes at least two partitioning walls extending in a second direction intersecting with the first direction, and is formed with at least three inlet ports partitioned by the partitioning walls in the first direction;

the filter is disposed along the entire length of the exhaust channel in the first direction over the partitioning walls at a position biased toward the one side of the duct;

the process unit includes a discharging unit configured to generate a discharge for charging the image-bearing member;

the at least two partitioning walls include a first partitioning wall nearest the process unit and a second partitioning wall nearest the fixing unit;

the duct includes a side wall located on a side near the process unit; and the plurality of current walls are disposed between the first partitioning wall and the side wall.

8. The image forming device according to claim 1, further comprising a restriction member configured to restrict an amount of air-flow into the exhaust channel, wherein the restriction member is disposed at a position between the second partitioning wall and the second side wall other than where the filter is located.

9. The image forming device according to claim 1, wherein one of the at least three inlet ports located nearest the fixing device is entirely covered with the filter.

10. An image forming device comprising:

a main casing;

a process unit including an image-bearing member onto which an electrostatic latent image is configured to be formed, a developing unit configured to supply developing agent to the electrostatic latent image formed on the image-bearing member to form a developing-agent image on the image-bearing member, and a transfer unit configured to transfer the developing-agent image from the image-bearing member onto a recording medium;

a fixing unit configured to thermally fix the developing-agent image onto the recording medium;

a duct disposed between the process unit and the fixing unit with respect to a first direction in which the recording medium is conveyed, the duct defining an exhaust channel for exhausting air out of the main casing; and a wall defining a reversing path through which the recording medium is conveyed from the fixing unit to the process unit through a position beneath the process unit after the developing-agent image is formed on one surface of the recording medium, wherein:

the duct includes at least two partitioning walls extending in a second direction intersecting with the first direction, and is formed with at least three inlet ports partitioned by the partitioning walls in the first direction; and the wall is formed with an opening that fluidly communicates the reversing path to a space in which the duct is disposed.

* * * * *